US005732431A

United States Patent [19]

McKinley

[11] Patent Number: 5,732,431

[45] Date of Patent: Mar. 31, 1998

[54] PORTABLE SCRUBBING DEVICE

[76] Inventor: Bruce C. McKinley, P.O. Box 3218, Shawnee Mission, Kans. 66203

[21] Appl. No.: 701,488

[22] Filed: Aug. 22, 1996

[51] Int. Cl.[6] ..... A47L 15/37

[52] U.S. Cl. ..... 15/21.1; 15/34; 15/65; 15/101

[58] Field of Search ..... 15/21.1, 30, 34, 15/36, 97.1, 97.2, 101, 59, 65, 73–75, 3.1, 56

[56] References Cited

U.S. PATENT DOCUMENTS

| | | | |
|---|---|---|---|
| D. 313,890 | 1/1991 | Machuron . | |
| 1,460,765 | 7/1923 | Norris . | |
| 2,230,350 | 2/1941 | Fielding | 15/74 |
| 2,774,088 | 12/1956 | Liska | 15/34 |
| 2,778,043 | 1/1957 | Arf . | |
| 3,078,484 | 2/1963 | Briggs | 15/21.1 |
| 3,417,417 | 12/1968 | Rhodes . | |
| 3,932,908 | 1/1976 | Bitgood et al. . | |
| 4,131,966 | 1/1979 | Gross . | |
| 4,137,588 | 2/1979 | Sandt et al. . | |
| 4,158,246 | 6/1979 | Meadows et al. . | |
| 4,299,004 | 11/1981 | Lancaster . | |
| 4,468,828 | 9/1984 | Nadolny et al. . | |
| 4,476,602 | 10/1984 | Hurn et al. . | |
| 4,724,563 | 2/1988 | Fry et al. . | |
| 4,791,693 | 12/1988 | Kvaternik | 15/74 |
| 5,315,729 | 5/1994 | Yang | 15/74 |
| 5,353,461 | 10/1994 | Enrquez . | |

FOREIGN PATENT DOCUMENTS

| | | | |
|---|---|---|---|
| 52-62545 | 5/1977 | Japan | 15/34 |

*Primary Examiner*—Terrence Till

*Attorney, Agent, or Firm*—Hovey, Williams, Timmons & Collins

[57] ABSTRACT

A portable scrubbing device (10) includes a support base (12) for placement on a generally horizontal surface, a motor (14) including a rotatable shaft (16) and mounted to the support base (12) so that the rotatable shaft (16) extends upwardly at an angle from the support base (12), and a brush (18) attached to the shaft (16) for rotation with the shaft (16). The shaft (16) includes a portion having a non-circular cross-section, and the brush (18) includes a sleeve (36) having a portion with a corresponding non-circular cross-section that mates with the shaft (16). The angle at which the shaft (16) is mounted relative to support base (12) and the shape of the shaft (16) and the sleeve (36) cooperate to hold the brush (18) on the shaft (16) and to rotate the brush (18) with the shaft (16) without the use of additional fasteners such as set screws or threaded fittings.

15 Claims, 1 Drawing Sheet

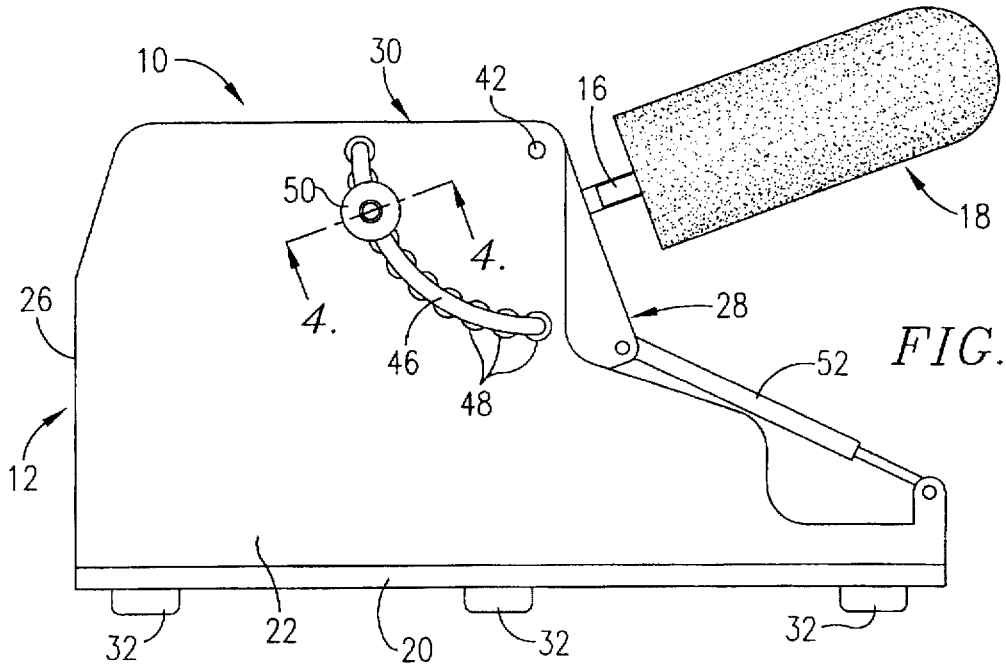
FIG. 1.
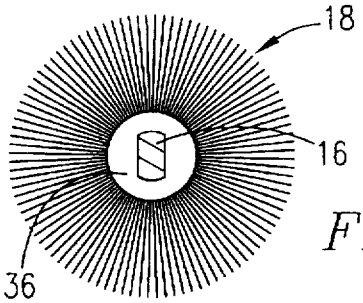
FIG. 3.
FIG. 4.
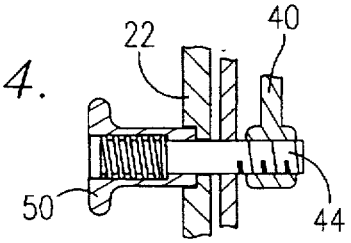
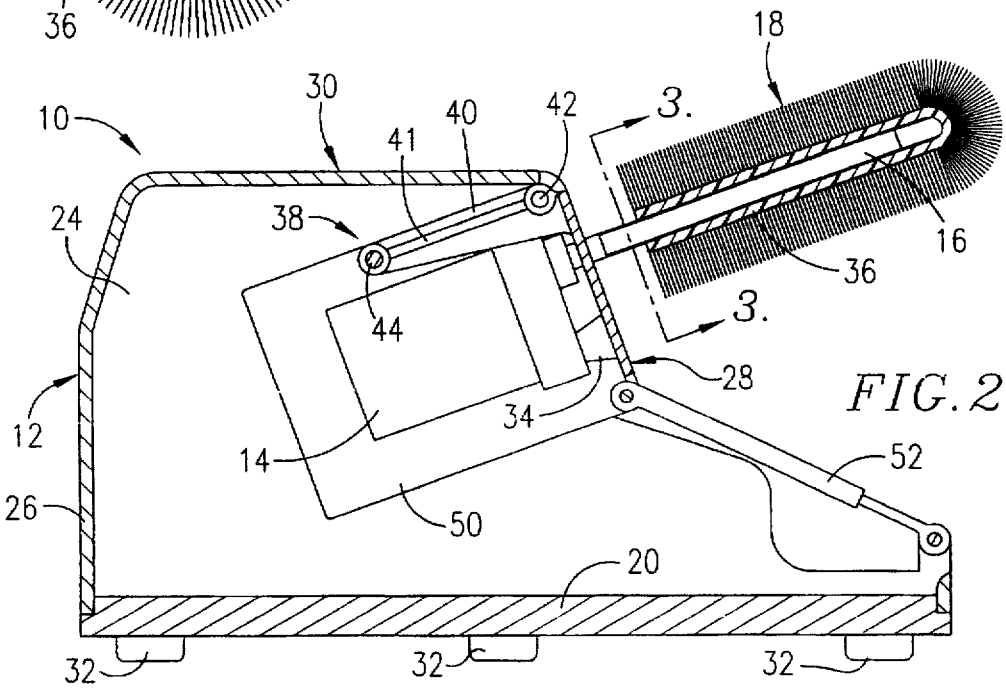
FIG. 2.

PORTABLE SCRUBBING DEVICE

BACKGROUND OF THE INVENTION

1. Field of the Invention

The present invention relates to scrubbing devices, and more particularly to a portable scrubbing device for scrubbing small articles such as fruits, vegetables, shoes, tools and other household items.

2. Description of the Prior Art

Prior art portable scrubbing devices have several limitations that limit their utility. For example, the brushes on prior art portable scrubbing devices are typically permanently mounted to the devices or held on the devices with set screws, threaded fittings, or similar fastening means. This construction makes it difficult to replace worn-out brushes or to switch between different types of brushes for different applications. Additionally, the set screws, threaded fittings or other fastening means often become covered with debris such as mud, snow, grease, vegetable parts, etc., removed from the articles being scrubbed, further increasing the difficulty of removing and replacing the brushes.

Another limitation of prior art portable scrubbing devices is that they are typically hand-held units or include hand-held brushes. Hand-held devices are difficult to use because the operator must use one hand to hold the devices, leaving only one hand to hold the articles that are being scrubbed.

A further limitation of prior art portable scrubbing devices is that their brushes are typically fixed in one position relative to their housings. The positions of the brushes therefore cannot be optimally adjusted for scrubbing certain types of articles.

SUMMARY OF THE INVENTION

The present invention solves the above-described problems and provides a distinct advance in the art of portable scrubbing devices. The portable scrubbing device of the present invention broadly includes a support base for placement on a generally horizontal surface, a motor mounted to the support base, the motor including a rotatable shaft, and a brush or other scrubbing device attached to the shaft for rotation with the shaft.

The motor is mounted to the support base so that its shaft extends upwardly at an angle from the support base. A portion of the shaft has a non-circular cross-section. The brush includes an elongated hollow sleeve that slips over the shaft for rotating the brush with the shaft. A portion of the sleeve also has a non-circular cross-section that mates with the non-circular portion of the shaft.

In preferred forms, the portable scrubbing device includes mounting structure for pivotally mounting the motor to the support base. The mounting structure permits the position of the motor to be adjusted relative to the support base to adjust the angle at which the shaft extends upwardly from the support base.

By constructing a portable scrubbing device as described herein, numerous advantages are realized. For example, by positioning the shaft at an angle relative to the support base and by providing the shaft and the hollow sleeve on the brush with mating non-circular portions, the brush is held on the shaft and rotated with the shaft without the use of set screws, threaded fittings, or other fastening means. This permits brushes to be quickly and easily placed on and removed from the shaft to replace worn-out brushes or to substitute different types of brushes for different applications.

Additionally, by mounting the motor and brush to a support base that is placed on a horizontal surface such as a counter top, an operator can use the portable scrubbing device while holding articles to be scrubbed with both hands.

Additionally, by providing the portable scrubbing device with mounting structure for pivotally mounting the motor to the support base and for adjusting the position of the motor relative to the support base, the angle at which the shaft extends upwardly from the support base can be adjusted to various positions for optimally scrubbing different types of articles.

BRIEF DESCRIPTION OF THE DRAWING FIGURES

A preferred embodiment of the present invention is described in detail below with reference to the attached drawing figures, wherein:

FIG. 1 is a side elevational view of a portable scrubbing device constructed in accordance with a preferred embodiment of the present invention;

FIG. 2 is a vertical section view of the portable scrubbing device illustrated in FIG. 1;

FIG. 3 is a section view of the shaft and brush of the portable scrubbing device taken along line 3—3 of FIG. 2; and FIG. 4 is a section view of the portable scrubbing device taken along line 4—4 of FIG. 1.

DETAILED DESCRIPTION OF THE PREFERRED EMBODIMENTS

FIGS. 1 and 2 illustrate portable scrubbing device 10 constructed in accordance with a preferred embodiment of the invention. Portable scrubbing device 10 is operable for scrubbing and cleaning small articles such as fruits, vegetables, shoes, tools and other household items and broadly includes support base 12, motor 14 mounted to support base 12, the motor including rotatable shaft 16, and brush 18 or other scrubbing or cleaning device attached to shaft 16 for rotation with the shaft.

In more detail, support base 12 is configured for supporting the other components of portable scrubbing device 10 on a generally horizontal surface such as a kitchen counter top. This permits an operator to use portable scrubbing device 10 while holding articles with both hands as the articles are being scrubbed.

Support base 12 is preferably formed of synthetic resin materials or other suitable materials and includes bottom wall 20, sidewalls 22,24, rear wall 26, front wall 28 and top wall 30. Walls 20,22,24,26,28 and 30 may be integrally formed in a molding process or may be separately formed and attached together with adhesives or other conventional fasteners.

Bottom wall 20 includes a plurality of rubber feet 32 for dampening the vibration of motor 14 and for preventing device 10 from inadvertently sliding across the horizontal surface on which it is placed. As best illustrated in FIG. 2, front wall 28 preferably depends from top wall 30 at an angle as described in more detail below.

Support base 12 is preferably approximately 10" wide, 13" long and 7" high. The entire portable scrubbing device 10 weighs approximately 10 pounds. Applicant has discovered that this size and weight permits an operator to scrub articles with all sides of brush 18 without tipping device 10 over or causing the device to slide across the horizontal surface on which it is placed. This size and weight also allows device 10 to be easily carried and transported, thus maintaining the portable nature of the device.

Motor 14 is a conventional AC or DC motor that is powered by either a 120 VAC electrical line or one or more DC batteries. Motor 14 is switched on and off in a conventional manner.

Rotatable shaft 16 extends from one end of motor 14 and is rotated by the motor. As best illustrated in FIG. 3, shaft 16 has a non-circular cross-section. In preferred forms, shaft 16 has an oblong cross-section.

Motor 14 is bolted or otherwise fastened to front wall 28 of support base 12. A spacer 34 may be attached between the shaft-side of motor 14 and the inside face of front wall 28 for spacing the motor 14 from front wall 28.

Motor 14 is preferably mounted to support base 12 at an angle so that shaft 16 extends upwardly from the support base at an angle between 10 and 90 degrees measured from the horizontal surface on which device 10 is placed. In preferred forms, motor 14 is positioned so that shaft 16 extends upwardly from support base 12 at an angle of 30 degrees. Applicant has discovered that this angle is optimum for scrubbing and cleaning fruits, vegetables and household items. This angle also permits an operator to exert a significant amount of downward force on brush 18 without tipping device 10 over.

Brush 18 includes an elongated hollow sleeve 36 and a plurality of bristles extending from the sleeve. Sleeve 36 slides over shaft 16 and rotates the brush with the shaft. As best illustrated in FIG. 3, the hollow portion of sleeve 36 has a non-circular cross-section that mates with the non-circular portion of shaft 16. In preferred forms, the hollow portion of sleeve 36 has an oblong cross-section.

Those skilled in the art will appreciate that brush 18 may be replaced with other cleaning and scrubbing devices such as a scrubbing pad or grinding stone.

The angle at which shaft 16 is mounted relative to support base 12 and the shape of the shaft and sleeve 36 cooperate to hold brush 18 on shaft 16 and to rotate the brush with the shaft without the use of additional fasteners such as set screws or threaded fittings. This permits brush 18 to be quickly and easily placed on and removed from shaft 16 to allow worn-out brushes to be replaced or different brushes to be used for different applications.

In preferred forms, portable scrubbing device 10 includes mounting structure broadly referred to by the numeral 38 in FIG. 2 for pivotally mounting motor 14 to support base 12. The drawing figures only illustrate one side of the scrubbing device 10 and therefore depict only one side of the mounting structure 38. The opposite side of the mounting structure is identical to the illustrated side. Mounting structure 38 permits the position of motor 14 to be adjusted relative to support base 12 to adjust the angle at which shaft 16 extends upwardly from the support base. Mounting structure 38 is preferably configured to permit motor 14 to be pivoted between an angle of 0–90 degrees measured from the horizontal surface on which device 10 is placed.

Mounting structure 38 includes a pair of elongated support arms 40 (only one shown) positioned on opposite sides of motor 14. Support arms 40 are preferably formed of molded synthetic resin materials or other suitable materials and each include a reinforcing rib 41 extending across the length thereof.

The forward end of each support arm 40 is pivotally connected to a corresponding sidewall 22,24 of support base 12 by hinge a pin 42 (only one shown) or other similar fastening device such as a rivet or bolt. This permits arms 40 to pivot relative to support base 12 about a horizontal pivot axis extending through hinge pins 42. The forward ends of arms 40 are attached or integrally formed with front plate 28 so that the front plate and motor 14 also pivot relative to support base 12 about hinge pins 42.

Mounting structure 38 also includes adjustment structure that permits an operator to easily adjust the position of motor 14 relative to support base 12 for changing the angle at which shaft 16 extends upwardly from the support base. This permits the angle of shaft 16 and brush 18 to be adjusted to various positions for optimally scrubbing different types of articles.

Specifically, the adjustment structure includes an elongated pin 44 that extends through the rear or unhinged ends of arms 40 to interconnect the arms. Pin 44 also extends through arcuate adjustment slots 46 formed in sidewalls 22,24.

Adjustment slots 46 and arms 40 are cooperatively sized and shaped to permit pin 44 to be feeely shifted along the length of the adjustment slots. Sidewalls 22,24 each include a plurality of spaced, circular recessed regions 48 formed along the length of their respective adjustment slots 46.

As best illustrated in FIG. 4, a pair of spring biased adjustment knobs 50 are secured over the ends of pin 44. The shank portion of each knob 50 fits into one of the recessed regions 48 for locking arms 40, front plate 28, and motor 14 in position relative to support base 12. To adjust the angle of motor 14 relative to support base 12, knobs 50 can be pulled out of their current recessed region, positioned adjacent a new recessed region, and released to once again lock arms 40, front plate 28, and motor 14 in position.

To prevent water and other debris from entering support base 12 through adjustment slots 46 and interfering with the operation of motor 14, device 10 may include a pair of thin, lightweight side plates 50 (only one shown) positioned on opposite sides of motor 14 for covering adjustment slots 46. Side plates 50 are preferably attached to pin 44 and hinge pins 42 between arms 40 and sidewalls 22,24 and pivot with motor 14 about hinge pins 42.

Side plates 50 may be also formed of stronger material and used to replace arms 40. Mounting structure 38 may also include a retractable water shield 52 pivotally connected between support plates 50 and side walls 22,24 to prevent water and other debris from entering the front of device 10.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

I claim:

1. A scrubbing device comprising:

a support base for placement on a generally horizontal surface;

a motor pivotally mounted to said support base, said motor including an elongated rotatable shaft extending upwardly at an angle from said support base, said shaft including a portion having a non-circular cross-section; and a cleaning tool including an elongated hollow sleeve positioned over said shaft for rotating said cleaning tool with said shaft, said sleeve including a portion having a non-circular cross-section that mates with said non-circular portion of said shafts wherein the upward angle of said shaft and said non-circular portions of said shaft and said sleeve cooperate for holding said cleaning tool on said shaft and for rotating said cleaning tool with said shaft without fastening said cleaning tool on said shaft with fasteners.

2. The scrubbing device as set forth in claim 1, said shaft extending upwardly from said support base at an angle between 10–80 degrees.

3. The scrubbing device as set forth in claim 1, said shaft extending upwardly from said support base at an angle of approximately 30 degrees.

4. The scrubbing device as set forth in claim 1, said non-circular portion of said shaft having an oblong cross-section.

5. The scrubbing device as set forth in claim 4, said non-circular portion of said sleeve having an oblong cross-section.

6. The scrubbing device as set forth in claim 1, said support base including a plurality of feet for supporting said scrubbing device on the horizontal surface.

7. A scrubbing device comprising:

a support base for placement on a generally horizontal surface;

a motor mounted to said support base, said motor including an elongated rotatable shaft extending upwardly at an angle from said support base, said shaft including a portion having a non-circular cross-section;

a cleaning tool including an elongated hollow sleeve positioned over said shaft for rotating said cleaning tool with said shaft, said sleeve including a portion having a non-circular cross-section that mates with said non-circular portion of said shaft; and mounting means for pivotally mounting said motor to said support base, said mounting means including adjusting means for adjusting the position of said motor relative to said support base for adjusting the angle at which said shaft extends upwardly from said support base.

8. A scrubbing device comprising:

a support base for placement on a generally horizontal surface;

a motor including an elongated rotatable shaft, said shaft including a portion having a non-circular cross-section;

mounting means for mounting said motor to said support base so that said shaft extends upwardly at an angle from said support base, said mounting means including adjusting means for adjusting the position of said motor relative to said support base for adjusting the angle at which said shaft extends upwardly from said support base; and a brush including an elongated hollow sleeve positioned over said shaft for rotating said brush with said shaft, said sleeve including a portion having a non-circular cross-section that mates with said non-circular portion of said shaft.

9. The scrubbing device as set forth in claim 8, wherein said upward angle of said shaft and said non-circular portions of said shaft and said sleeve cooperate for holding said brush on said shaft and for rotating said brush with said shaft without the use of additional fasteners.

10. The scrubbing device as set forth in claim 8, said shaft extending upwardly from said support base at an angle between 10–80 degrees.

11. The scrubbing device as set forth in claim 8, said shaft extending upwardly from said support base at an angle of approximately 30 degrees.

12. The scrubbing device as set forth in claim 8, said non-circular portion of said shaft having an oblong cross-section.

13. The scrubbing device as set forth in claim 12, said non-circular portion of said sleeve having an oblong cross-section.

14. The scrubbing device as set forth in claim 8, said support base including a plurality of feet for supporting said scrubbing device on the horizontal surface.

15. A scrubbing device comprising:

a support base including a plurality of feet for supporting said scrubbing device on a generally horizontal surface;

a motor including an elongated rotatable shaft, said shaft including a portion having an oblong cross-section;

mounting means for pivotally mounting said motor to said support base so that said shaft extends upwardly at an angle from said support base, said mounting means including adjusting means for adjusting the position of said motor relative to said support base for adjusting the angle at which said shaft extends upwardly from said support base; and a brush including an elongated hollow sleeve positioned over said shaft for rotating said brush with said shaft, said sleeve including a portion having an oblong cross-section that mates with said oblong portion of said shaft, wherein said upward angle of said shaft and said oblong portions of said shaft and said sleeve cooperate for holding said brush on said shaft and for rotating said brush with said shaft without the use of additional fasteners.

* * * * *